United States Patent [19]

Altman

[11] Patent Number: 4,739,815

[45] Date of Patent: Apr. 26, 1988

[54] BALLOON CURTAIN

[75] Inventor: Alan H. Altman, Great Neck, N.Y.

[73] Assignee: Beacon Looms, Teaneck, N.J.

[21] Appl. No.: 89,920

[22] Filed: Aug. 25, 1987

Related U.S. Application Data

[63] Continuation of Ser. No. 769,578, Aug. 26, 1985, abandoned.

[51] Int. Cl.[4] ..... E06B 3/94

[52] U.S. Cl. ..... 160/84.1; 160/330

[58] Field of Search ..... 160/84 R, 330, 178 C; 24/136 R, 136 A, 136 K, 136 L

[56] References Cited

U.S. PATENT DOCUMENTS

| | | | |
|---|---|---|---|
| 978,220 | 12/1910 | Sarkisian . | |
| 1,321,800 | 11/1919 | Andress et al. | 160/84 R |
| 2,295,137 | 9/1942 | Sutton . | |
| 2,910,120 | 10/1959 | Rosen . | |
| 3,160,202 | 12/1964 | Rosen . | |
| 3,338,291 | 9/1967 | Kintner . | |
| 3,433,281 | 3/1969 | Lukashok | 160/330 |
| 3,439,725 | 4/1969 | Haimovitz et al. . | |
| 3,777,800 | 12/1973 | Susoev . | |
| 3,965,544 | 6/1976 | Boden | 24/136 R |
| 3,996,987 | 12/1976 | Rodriguez . | |

FOREIGN PATENT DOCUMENTS

| | | | |
|---|---|---|---|
| 1271921 | 4/1986 | Fed. Rep. of Germany | 160/84 R |

*Primary Examiner*—Ramon S. Britts
*Assistant Examiner*—David M. Purol
*Attorney, Agent, or Firm*—Brumbaugh, Graves, Donohue & Raymond

[57] ABSTRACT

A balloon curtain mountable on a U-shaped two-piece telescoping curtain rod includes adhesive backed nylon fastening tabs attachable to the curtain rod, preferably at the ends and middle of the rod, a generally rectangular fabric body having a top and a bottom, with the top having a tubular pocket for receiving the curtain rod, a second pair of nylon fastening tabs attached inside the curtain rod pocket of the fabric body so as to be opposite to, and engageable with, the curtain rod end tabs when the curtain rod is inserted into the tubular pocket of the body. The curtain also has a pull cord mechanism for vertically raising and lowering the bottom of the fabric body, and a holding sleeve for selectively holding the pull cords and the bottom of the fabric body in a desired position.

2 Claims, 1 Drawing Sheet

BALLOON CURTAIN

This application is a continuation of application Ser. No. 769,578, filed on 8-26-85, now abandoned.

BACKGROUND OF THE INVENTION

The present invention relates to the field of window curtains and, more particularly, to a vertically movable balloon draw curtain.

Some prior art curtains of this type have been difficult to mount and/or have shifted around on the rod. Moreover, a different size curtain is typically required for each different window width, requiring the manufacture and retail stocking of many curtain sizes. Further, some prior art curtains require special mounting hardware which further increases cost to the consumer and sometimes puts the installation procedure above the capability of the average consumer.

SUMMARY OF THE INVENTION

It is an object of the present invention to provide a balloon curtain which is easily mountable on a curtain rod and which can be attached in a simple manner to a window of substantially any width within a certain range of widths.

It is another object of the invention to provide the balloon curtain with an improved means for drawstring adjustment.

Pursuant to these objects, and others which will become apparent hereafter, one aspect of the invention resides in a balloon curtain which is mountable on a standard curtain rod. The balloon curtain comprises a first pair of nylon fastening tabs attachable to the curtain rod with each tab located at a different end of the rod, a fabric body having a top and a bottom, said top being provided with a tubular pocket for receiving the curtain rod, a second pair of fastening tabs, each being attached to a different end and inside the curtain rod pocket of the fabric body so as to be engageable with the curtain rod end tabs when the curtain rod is inserted into the pocket, means for vertically raising and lowering the bottom of the fabric body and means for selectively holding the bottom of the fabric body in a desired vertical position.

As a result, a relatively inexpensive curtain is provided which is relatively easy to install, which can be used for a window of substantially any width in a range of widths due to the balloon design, and can have its height quickly and easily adjusted.

The novel features which are considered as characteristic for the invention are set forth in particular in the appended claims. The invention itself, however, both as to its construction and its method of operation, together with additional objects and advantages thereof, will be best understood from the following description of the specific embodiment thereof when read in connection with the accompanying drawings.

DESCRIPTION OF THE PREFERRED EMBODIMENTS

Figure 1:
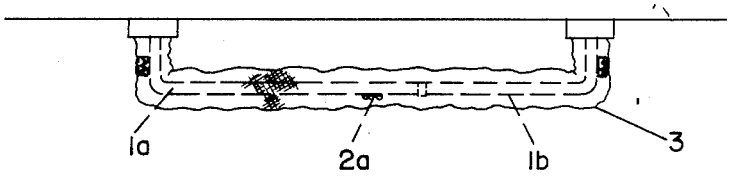
FIG. 1 is a top view of a curtain according to the present invention, mounted on a curtain rod.

As can be seen from the drawings, a U-shaped curtain rod 1, having one portion 1*a* adapted to telescope with another portion 1*b*, is provided with three adhesive backed nylon fastening tabs 2*a*. One tab 2*a* is attached to each end of the rod 1, and one is located about midway along the rod after the rod is sized for a particular window. The curtain and rod are intended to be adapted for use with a variety of window widths (within a certain range of widths). For a two piece U-shaped curtain rod as shown, the midpoint of the rod where the middle tab is to be attached should be determined after adjusting the rod length to the width of the window.

The curtain is made of a rectangular fabric body 3 which has a tubular curtain rod pocket 3*a* at its top for accepting the curtain rod 1. Two additional fastening tabs 2*b* are provided in the rod pocket 3*a* so that they are aligned to oppose the tabs 2*a* on the ends of the curtain rod 1. These additional fastening tabs 2*b* are preferably sewn into the rod pocket 3*a*. When the curtain rod 1 is inserted into the rod pocket 3*a*, the tab 2*b* will engage with the tab 2*a* and thereby hold the ends of the fabric body 3 on the curtain rod 1. The fabric forming the rod pocket 3*a* is preferably of a type and texture so that it will engage the center tab 2*a* of the curtain rod 1, to prevent the top center of the curtain from sliding on the rod 1 and giving the curtain an uneven appearance. The fastening tabs 2*a* and 2*b* are preferably made of nylon and are commercially available under the designation "Velcro". However, they may be made of any material which adheres to another similar piece of material when the materials are pressed against each other.

The bottom of fabric body 3 is drawn vertically by a plurality of pull cords 5 which pass through a series of eyelets 4 fastened to the back of the fabric body 3. The pull cords 5 are fastened equidistant from one another to the bottom of the body 3 and run vertically through the eyelets 4 to the top of the body 3 where the cords 5 are trained in a strand 6 which runs through eyelets 4, out to the side of the body 3, and terminates in a knot 8. The knot 8 may be untied to permit adjustment of one of the cords relative to the other cords so that the bottom edge of the curtain is horizontally level and can be evenly raised and lowered.

Figure 2:
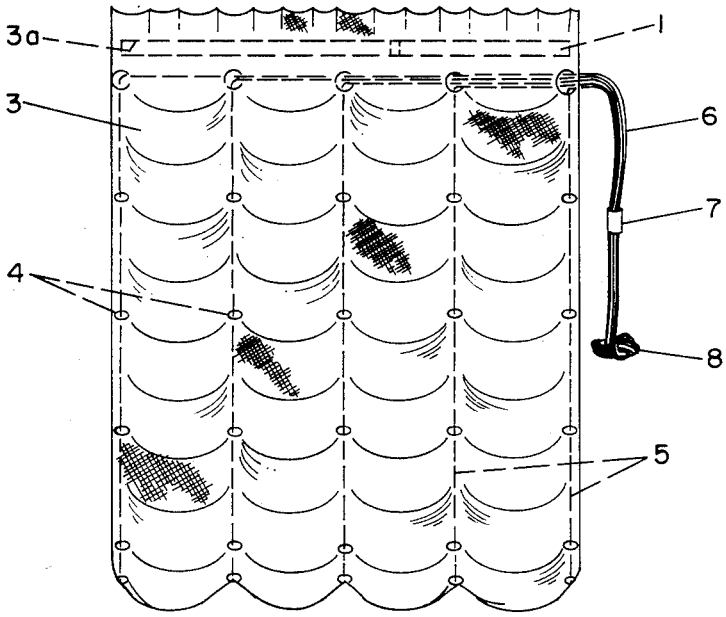
FIG. 2 is a front elevational view of the curtain pursuant to the present invention.
Figure 3:
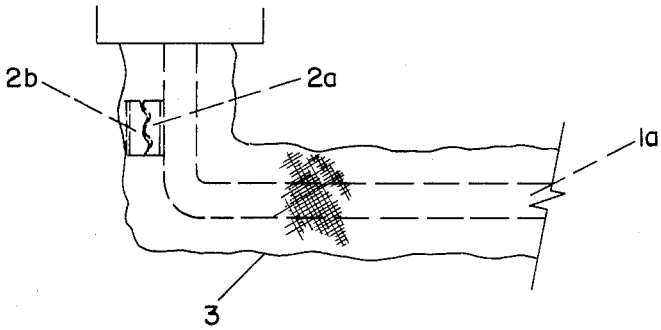
FIG. 3 is an enlarged view of a portion of the curtain and curtain rod showing engagement of the fastening tabs.

The fabric at the bottom of the curtain, where the ends of the cords 5 are attached to the curtain, is preferably shirred, i.e. the fabric has alternate folds about ½ inches apart to create about five layers, and then the fabric is sewn to the bottom eyelet to maintain the folds. This shirring process creates the scalloped effect at the bottom of the curtain as shown in FIG. 2.

A hollow tubular shade lock sleeve 7 is provided on the strand 6 between the knot 8 and the side of the fabric body 3 through which the strand 6 passes. The sleeve 7 is provided on the strand 6 so that it is movable by hand but not freely slidable without the application of some force. When the bottom of the body 3 is raised or lowered to a desired position, the sleeve 7 is slid up the strand 6 of cord 5 until it reaches the first eyelet 4 at the side of the body 3 through which the strand 6 passes. In this position, since the sleeve 7 is larger than the eyelet 4, the sleeve prevents the cords 5 from moving and changing the vertical position of the bottom of the curtain.

While the invention has been illustrated and described as embodied in a balloon curtain, it is not intended to be limited to the details shown, since various modifications and structural changes may be made without departing from the spirit of the present invention.

What is claimed as new and desired to be protected by letters patent is set forth in the appended claims.

I claim:

1. A balloon curtain mounted on a standard U-shaped curtain rod, comprising, in combination:

a plurality of adhesive backed nylon fastening tabs attached to said curtain rod, including one tab located at each end of the rod and a center tab located about midway therebetween;

a generally rectangular fabric body having a back, a side, a top and a bottom, said top being provided with a tubular pocket for receiving the curtain rod, said tubular pocket being made of a fabric which is engageable with said center tab on the curtain rod;

a pair of adhesive backed nylon fastening tabs, each tab being attached to a different end of and inside said curtain rod pocket of said fabric body so as to be opposite to, and engageable with, said curtain rod end tabs when the curtain rod is inserted into said tubular pocket of said body, whereby, when the curtain is wider than the length of the curtain rod, the curtain may be freely shirred along the rod, while the center and ends of the curtain are held in place at the curtain rod center ends, respectively, so that a single curtain is useable on curtain rods of varying length;

a plurality of eyelets arranged in equally spaced vertical columns on said back of said fabric body;

a plurality of pull cords including one cord corresponding to each column of said eyelets, said one cord of each said column having one end fixed to a lower most eyelet in said column at the bottom of the fabric body, said cords running vertically in their respective columns from said fixed ends through the remaining eyelets in said columns to said top of said fabric body where said cords are trained in a strand running horizontally to said side of said fabric body so as to allow for vertical movement of the bottom of said body by pulling said strand; and a hollow tubular sleeve larger than the first eyelet through which said strand runs, said sleeve being forceably slidable on said strand of cords, said sleeve frictionally contacting and holding said strand of cords and holding the bottom of said fabric body when said sleeve is held from passage through the eyelet but wherein said strand is slidable within said sleeve upon application of a sliding force.

2. A balloon curtain as defined in claim 1, wherein said fastening tabs are made of (Velcro) adhesive backed nylon fastening material.

* * * * *